US005406681A

United States Patent [19]

Olson

[11] Patent Number: 5,406,681

[45] Date of Patent: Apr. 18, 1995

[54] LOCK FOR SAFETY BELT

[75] Inventor: Ulf Olson, Gislaved, Sweden

[73] Assignee: Broderna Holmbergs Fabriks AB, Anderstorp, Sweden

[21] Appl. No.: 108,721

[22] PCT Filed: Mar. 3, 1992

[86] PCT No.: PCT/SE92/00130

§ 371 Date: Sep. 1, 1993

§ 102(e) Date: Sep. 1, 1993

[87] PCT Pub. No.: WO92/15216

PCT Pub. Date: Sep. 17, 1992

[30] Foreign Application Priority Data

Mar. 4, 1991 [SE] Sweden ..... 9100611

[51] Int. Cl.[6] ..... A44B 11/26

[52] U.S. Cl. ..... 24/650; 24/573.5

[58] Field of Search ..... 24/650, 647, 651, 637, 24/636, 573.5

[56] References Cited

U.S. PATENT DOCUMENTS 3,378,895 4/1968 Eberhart ..... 24/650
3,686,720 8/1972 Wehner .
4,408,373 10/1983 Miskowicz .
4,677,715 7/1987 Escaravage .

*Primary Examiner*—James R. Brittain
*Attorney, Agent, or Firm*—Joseph C. Mason, Jr.; Ronald E. Smith

[57] ABSTRACT

Buckle for a safety belt, particularly a children's belt, comprising a buckle housing (10) and a lock tongue (13) constructet to be connected each to one strap part. The lock tongue is insertable into a guide (15) in the buckle housing which has a latch member (19) spring biased to lockingly engage the inserted lock tongue, and an opening member (20) to be operated manually for switching the latch member from an engaged position to a disengaged position against the spring bias, said two members consisting of one and the other, respectively, limb of a U-shaped element (17) which is pivotally mounted in the buckle housing (10) to switch about a transverse axis (21) with the limbs extending along the guide (15) towards the insertion opening (12) for the lock tongue (13) which at the insertion into the buckle housing can be pushed in between the limbs. The spring bias consists of a pressure spring (26) mounted between the limbs one end of said spring abutting the web of the U-shaped element, the lock tongue at the insertion between the limbs being engageable with the other end of the spring to tension of pressure spring which is provided also as ejector for the lock tongue.

10 Claims, 2 Drawing Sheets

LOCK FOR SAFETY BELT

The invention relates to a buckle for a safety belt, particularly a child's belt of the type used in combination with a child's chair which is located on a seat and is anchored to the car.

The buckle according to the invention comprises a buckle housing and a lock tongue constructed to be connected each to one strap part, the lock tongue being insertable into a guide in the buckle housing which has a latch member spring biased to lockingly engage the inserted lock tongue, and an operating member to be operated manually for switching the latch member from an engaged position to a disengaged position against the spring bias.

Buckles of this general kind are disclosed in U.S. Pat. Nos. 3,686,720, 4,677,715, and 4,408,373.

In the buckle disclosed in U.S. Pat. No. 3,686,720, the latch member and the operating member consist of a first limb and a second limb, respectively, of a U-shaped element, which is pivotally mounted in the buckle housing to swing about a transverse axis, with the limbs extending along the guide towards the insertion opening for the lock tongue which at the insertion into the buckle housing can be pushed in between the limbs.

In the buckle disclosed in U.S. Pat. No. 4,677,715, the spring bias consists of a pressure spring mounted between the limbs of a U-shaped element. One end of the pressure spring is attached to a stud protruding inwardly from the upper limb of the U-shaped element, and the other end of the spring is mounted on a stud protruding from a separate sliding block which is guided for linear movement in the belt housing. The sliding block is caused to move by inserting a lock tongue into the housing, thereby exerting a pushing action on said sliding block.

In the buckle disclosed in U.S. Pat. No. 4,408,373, the lock housing is provided with grooves for guiding the lock tongue when inserted therein.

It is the intention to provide by the invention a buckle of this kind which combines an extremely uncomplicated construction with high safety and reliability and wherein the uncomplicated construction is achieved by the buckle consisting of very few elements which are of a simple construction and are mounted together in a simple manner. As a consequence thereof the buckle can be made small and light, which is desired as far as buckles for a child's belt is concerned.

Figure 1:
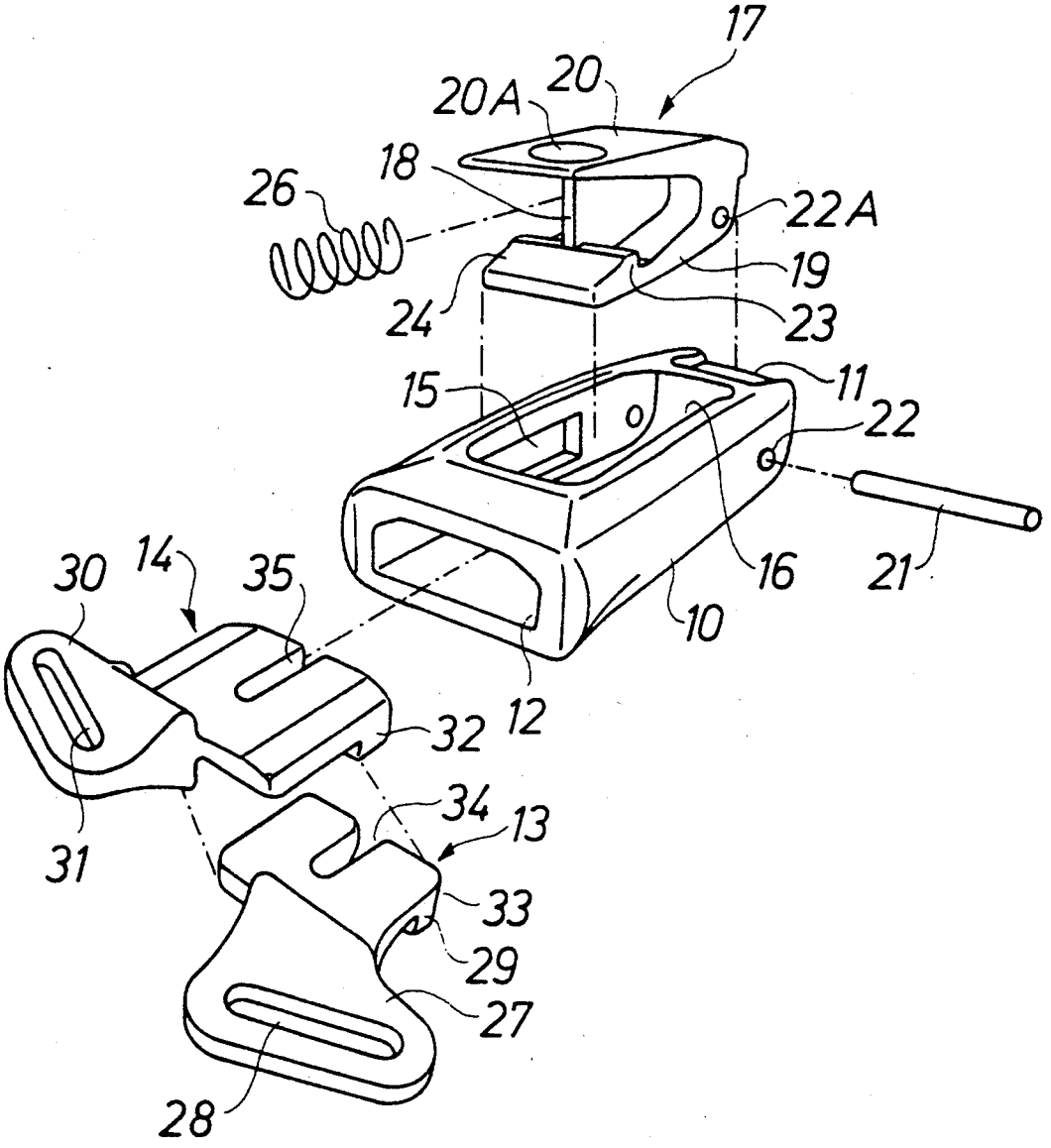
Figure 2:
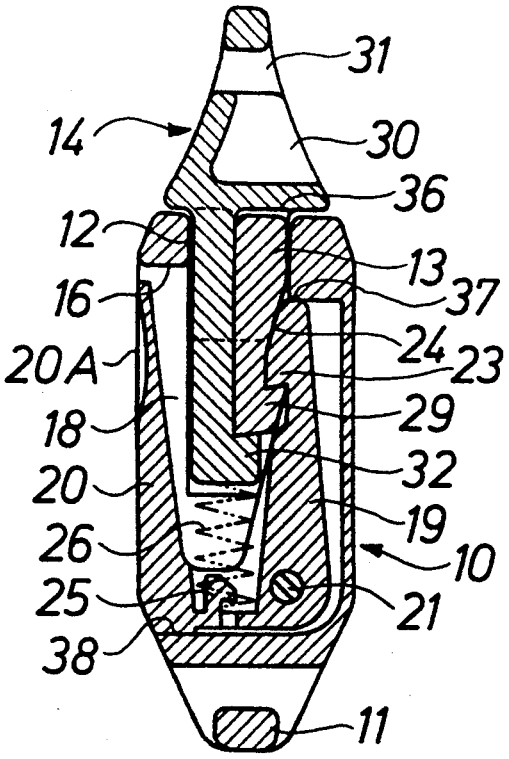
Figure 3:
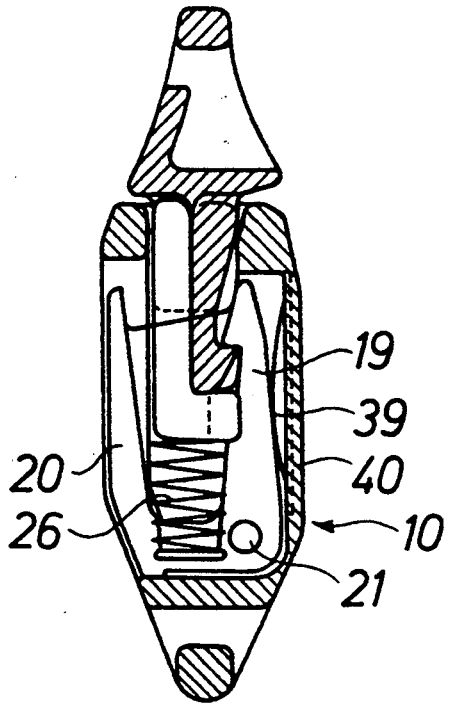

An embodiment of the buckle according to the invention will be described below reference being made to the accompanying drawings in which FIG. 1 is an exploded perspective view of a child's buckle for a belt having a crotch strap and two shoulder straps, FIG. 2 is a vertical cross sectional view of the buckle in FIG. 1, and FIG. 3 is a vertical cross sectional view similar to FIG. 2 of a buckle of a slightly modified embodiment.

The buckle comprises a buckle housing 10 of generally parallelepiped configuration which can be injection moulded of a suitable plastic material and has at one end thereof a cross bar 11 to be connected at said cross bar to a crotch strap forming part of a child's belt, said part extending downwards between the child's legs and is fixedly anchored below. The buckle housing forms at the other end thereof a slot opening 12 for insertion of two lock tongues 13 and 14 which shall be connected each to one shoulder strap. Inside the buckle housing there is provided along each of the opposite sides of the housing a linear guide groove 15 for guiding the lock tongues when they are inserted into the buckle housing through the opening 12. In one of the flat sides of the buckle housing an opening 16 is provided. A U-shaped element 17 stiffened by means of a flange 18 extending between the two limbs 19 and 20 of the element and along said limbs, is inserted into the buckle housing through the opening 16 and is pivotally mounted in the buckle housing by means of a pin 21 which is inserted transversely of the buckle housing into apertures 22 therein and extends through an aperture 22A in the element 17, said latter aperture being located in the transition between the web of the element and the limb 19. The limbs 19 and 20 extend along the guides 15 towards the opening 12.

The U-shaped element 17 forms a latch member as well as an operating member of the buckle. The limb 19 forms the latch member and for this purpose has a slightly undercut latch dog 23 forming a beveled surface 24, and the limb 20 forms the operating member and is available for manual operation through the opening 16. This limb has a dimple forming a pressure point 20A on the outside thereof. On one side of the flange 18 the element 17 has a hook 25 extending along said flange, for fixedly positioning one end of a helical spring 26 which extends along the flange 18 at one side thereof and functions as a spring for biasing the latch dog 23 to the engaged position as well as an ejection spring.

The lock tongue 13 has a lug 27 with a slot 28 therein for connection of the related shoulder strap which shall extend upwards over the shoulder of the person to be belted and shall be fixedly anchored behind the seat or chair or in the back thereof. Moreover, the lock tongue forms a hook 29 which is undercut in a corresponding manner as the latch dog 23 and is constructed to engage with said latch dog. In a corresponding manner the lock tongue 14 has a lug 30 with a slot 31 for the connection of the related shoulder strap, and it forms also a hook 32 which is also undercut. When the lock tongue 14 is disposed on top of the lock tongue 13 the hook 32 shall engage an edge surface 33 on the lock tongue 13, which is formed in a corresponding way, as shown in FIG. 2. The two lugs are angled in opposite directions as can be seen in FIG. 1 in order not to interfere with each other when the two lock tongues are put together with one lock tongue disposed on top of the other. Both lock tongues have a slot 34 and 35 respectively, to receive therein the flange 18 of the element 17 when they are pushed into the buckle housing.

When the two lock tongues put together in the manner described are pushed into the buckle housing 10 through the opening 12 they will be guided linearly by the guides 15 in the lock housing between the limbs 19 and 20. The end edge of the lock tongue 14 will abut the free end of the spring 26 such that the spring will be compressed and put under tension when the lock tongues are being inserted, which means that the element 17 will be biased to swing counter-clockwise as seen in FIG. 2 about the pivot axis defined by the pin 21. The limb 19 thus will be swung towards the lock tongues under the spring bias but will be pushed aside by cam action of the lock tongue 13 against the spring bias by said lock tongue sliding against the beveled surface 24. When the lock tongues are completely inserted, which is indicated by shoulders 36 formed by the lugs engaging the end wall of the buckle housing, the element 17 will be swung counter-clockwise as seen in FIG. 2 under the influence of the tensioned spring 26, the latch dog 23 at the same time engaging the hook 29 of the lock tongue 13. Now, the lock tongues are lockingly engaged with the buckle housing. The tension load to which the lock tongues and the buckle housing may be exposed when the belt is being used, will be taken up by the buckle housing not only via the pin 21 but also at the free end of the limb 19, said end engaging at 37 the end wall of the buckle housing wherein the opening 12 is provided. It should also be noted that the position of the element 17 is defined by a projection 38 on said element engaging the other end wall of the buckle housing, the limb 20 of the element 17 being substantially flush with the flat side of the buckle housing in the opening 16.

In order to disengage the lock tongues from the buckle housing when the belt is to be taken off pressure is applied to the element 17 at the pressure point 20A on the limb/operating member 20 in order that the element 17 will be swung clockwise as seen in FIG. 2 against the bias of the tensioned spring 26 so that the latch dog will disengage the hook 29 on the lock tongue 13. When this happens the spring 26 functioning as an ejection spring can push the lock tongues out of the buckle housing.

Thus, it will be seen that the buckle according to the invention has one movable element only, namely the element 17 which forms the latch member as well as the operating member, and one spring only, namely the spring 26 which is a spring biasing the latch member and an ejection spring. Totally the buckle comprises (excluding the lock tongues) four elements only: the buckle housing 10, the element 17, the pin 21, and the spring 26, an extremely low number of elements of a lock of the type referred to herein. It has been possible to obtain this simplification of the lock without renouncing safety and reliability.

If it is desired to increase the pressure required in order to disengage the buckle when pressure is exerted on the element 17 at the pressure point 20A, a leaf spring 39 can be provided according to FIG. 3 between the buckle housing 10 and the limb 19 of the U-shaped element 17, the opposite ends of the leaf spring being displaceably received by a shallow groove 40 in the buckle housing and the spring being bow-shaped to engage between the ends thereof the limb 19. The leaf spring can be replaced by a helical spring provided as a pressure spring between the buckle housing and the limb 19.

The buckle described is a children's buckle, i.e. a buckle for such belts as are used in combination with a child's chair, but it is realized that the lock can be used also with other car belts, the buckle housing and one lock tongue being connected with a hip strap, and the other lock tongue being connected with a shoulder strap when the lock is used in combination with a common car belt of the three point type. It is, of course, not necessary that two lock tongues can be inserted into the buckle housing. The buckle can be constructed also for one lock tongue only as when the shoulder strap of a three point belt passes through a slot in the single lock tongue and is integral with a hip strap part, or in case of a hip belt wherein the lock tongue and the buckle housing are connected each with one hip strap part.

I claim:

1. A lock for a safety belt, comprising:

a buckle housing of generally parallelepiped construction, said buckle housing having a top wall, a bottom wall, a pair of transversely spaced apart side walls, a front wall and a back wall;

an insertion opening formed in said front wall and an access opening formed in said top wall;

a generally U-shaped latch member having a pair of parallel limbs interconnected by a bight section, each limb of said parallel limbs having a base integrally formed with said bight section, said U-shaped latch member being disposed within said buckle housing;

a transversely extending pivot pin extending through said side walls of said buckle housing and through said U-shaped latch member to pivotally mount said U-shaped latch member with respect to said buckle housing;

a latch dog being formed on a first limb of said pair of parallel limbs;

a bias means disposed between said pair of limbs, a first end of said bias means being supported by said bight section;

a first lock tongue sized to enter into said buckle housing through said insertion opening formed in said front wall of said buckle housing, said first lock tongue having a leading edge that compresses said bias means and causes said U-shaped latch member to pivot about said pivot pin upon introduction of said first lock tongue into said buckle housing;

said first lock tongue having a hook for engaging said latch dog when said first lock tongue is fully inserted into said buckle housing, said engagement maintaining said first lock tongue within said buckle housing;

said first lock tongue hook being disengaged from said latch dog by an externally imparted force that pivots said U-shaped latch member away from said first lock tongue so that said hook and latch dog disengage so that said first lock tongue may be withdrawn from said buckle housing, said externally imparted force being applied to said U-shaped latch member through said access opening formed in said top wall of said buckle housing.

2. The lock of claim 1, further comprising a longitudinally extending stiffening flange that extends between said pair of parallel limbs, and further comprising a longitudinally extending slot formed in said first lock tongue to accommodate said stiffening flange when said first lock tongue is inserted into said buckle housing.

3. The lock of claim 1, further comprising a guide groove formed in an interior side of each of said side walls of said buckle housing for guiding said first lock tongue as it is inserted into said buckle housing.

4. The lock of claim 1, wherein said pivot pin extends through said base of said first limb of said U-shaped latch member so that compression of said bias means by said leading edge of said first lock tongue causes said first limb and said latch dog formed thereon to pivot toward said access opening formed in said top wall of said buckle housing and hence toward said first lock tongue.

5. The lock of claim 1, wherein said first limb has a free end that abuts an interior surface of said buckle housing front wall.

6. The lock of claim 1, wherein said bight section of said U-shaped latch member abuts an interior surface of said buckle housing back wall.

7. The lock of claim 1, wherein said second limb of said U-shaped latch member is accessible through said access opening formed in said buckle housing top wall.

8. The lock of claim 1, further comprising a second lock tongue having a hook, said second lock tongue disposed in overlying, coplanar relation to said first lock tongue, said second lock tongue having a hook formed in a leading edge thereof to engage the leading edge of said first lock tongue, and said leading edge of said second lock tongue compressing said bias means when said second lock tongue and said first lock tongue are inserted into said buckle housing through said insertion opening.

9. The lock of claim 1, further comprising a leaf spring disposed between said first limb and an interior surface of said bottom wall of said buckle housing.

10. The lock of claim 9, further comprising a shallow groove formed in said interior surface of said buckle housing bottom wall, and wherein opposite ends of said leaf spring engage opposite ends of said shallow groove so that said leaf spring offers resistance to pivoting of said U-shaped latch member when said U-shaped latch member is pivoted about said pivot pin by said externally imparted force.

* * * * *